US005806145A

United States Patent [19]

Chen

[11] Patent Number: 5,806,145

[45] Date of Patent: Sep. 15, 1998

[54] BELT BUCKLE

[76] Inventor: Kuo-Jen Chen, No. 2-1, Lane 48, Tai-Yuan Rd., Taipei, Taiwan

[21] Appl. No.: 972,324

[22] Filed: Nov. 18, 1997

[51] Int. Cl.[6] ..... A44B 11/00

[52] U.S. Cl. ..... 24/170; 24/191

[58] Field of Search ..... 24/170, 191, 184, 24/311, 265 BC, 585

[56] References Cited

U.S. PATENT DOCUMENTS

| | | | |
|---|---|---|---|
| 2,327,741 | 8/1943 | Poole | 24/170 |
| 3,818,548 | 6/1974 | Meyerson | 24/170 |
| 4,733,440 | 3/1988 | Ogawa | 24/170 |
| 5,291,638 | 3/1994 | Huang | 24/191 |
| 5,588,186 | 12/1996 | Ko | 24/170 |

*Primary Examiner*—Victor N. Sakran
*Attorney, Agent, or Firm*—Bacon & Thomas

[57] ABSTRACT

A belt buckle which includes a base frame fastened to a lead end of a belt, the base frame having a locating plate with a notch, a holder frame fastened to the base frame, the holder frame having a chamber and a front opening disposed in communication with the chamber, a locking mechanism pivoted to the holder frame in its front opening and moved between a locking position where the locking mechanism is moved into the notch on the locating plate to hold down a tail end of the belt, and an unlocking position where the locking mechanism is moved out of the notch on the locking plate to release the tail end of the belt, and a release control unit mounted in the chamber of the holder frame and controlled to move the locking mechanism from the locking position to the unlocking position.

8 Claims, 3 Drawing Sheets

BELT BUCKLE

BACKGROUND OF THE INVENTION

The present invention relates to belt buckles, and more particularly to such a belt buckle which comprises a base frame fixed to a lead end of a belt, a holder frame fastened to the base frame, a locking mechanism adapted to lock a tail end of the belt, and a release control unit controlled to release the locking mechanism.

U.S. Pat. No. 4,699,155 discloses a belt buckle which comprises a base frame fastened to the lead end of the belt, a locking mechanism mounted in holder means on the base frame and adapted to lock the tail end of the belt. When the tail end of the belt is inserted into the base frame, the locking mechanism allows the tail end of the belt to pass. When the tail end of the belt is moved backwards, the locking mechanism engages a serrated portion on the back side of the tail end of the belt, therefore the tail end of the belt is stopped from backward movement. When to release the locking mechanism from the serrated portion of the tail end of the belt, the base frame of the buckle must be turned through a certain angle relative to the belt. This release control procedure is inconvenient to perform. Further, when turning the base frame relative to the belt, the abdomen may feel uncomfortable.

SUMMARY OF THE INVENTION

The present invention has been accomplished to provide a belt buckle which eliminates the aforesaid drawbacks. According to one aspect of the present invention, the belt buckle comprises a locking mechanism mounted in a holder frame on a base frame thereof and forced by spring means to lock the belt, and a release control unit mounted on the holder frame and conveniently controlled to release the locking mechanism. According to another aspect of the present invention, the locking mechanism comprises a locking lever forced by a spring to lock the belt; the release control unit comprises a control bolt supported on a spring, and a pressure block fastened to the bottom end of the control bolt, the pressure block being forced to move the locking lever out of the locking position when the control bolt is pressed down.

DETAILED DESCRIPTION OF THE PREFERRED EMBODIMENT

Figure 1:
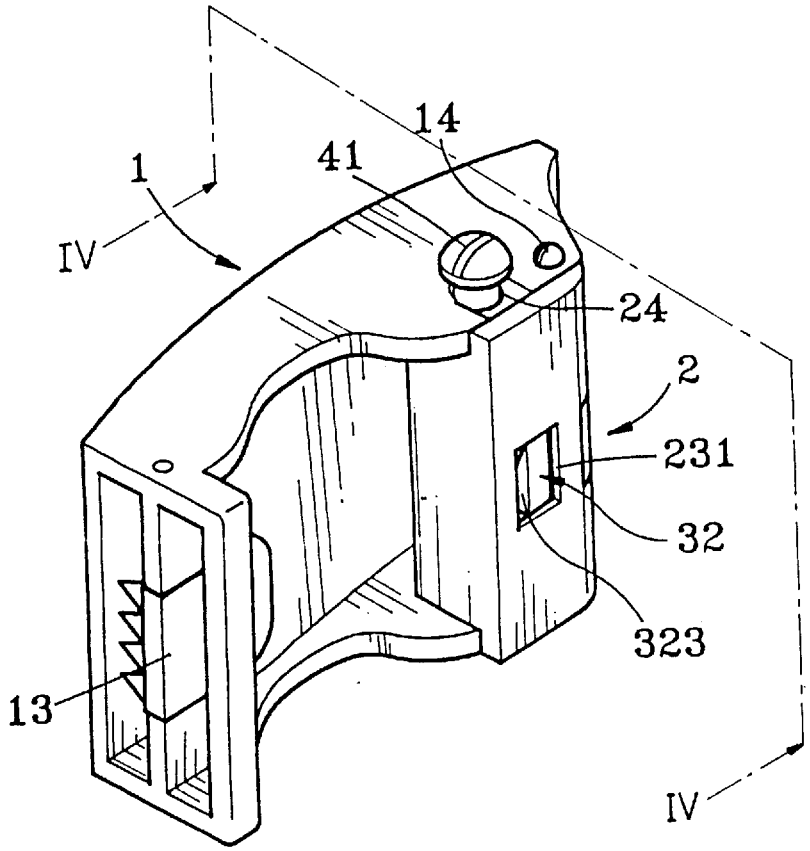
FIG. 1 is a perspective view of a belt buckle according to the present invention.
Figure 2:
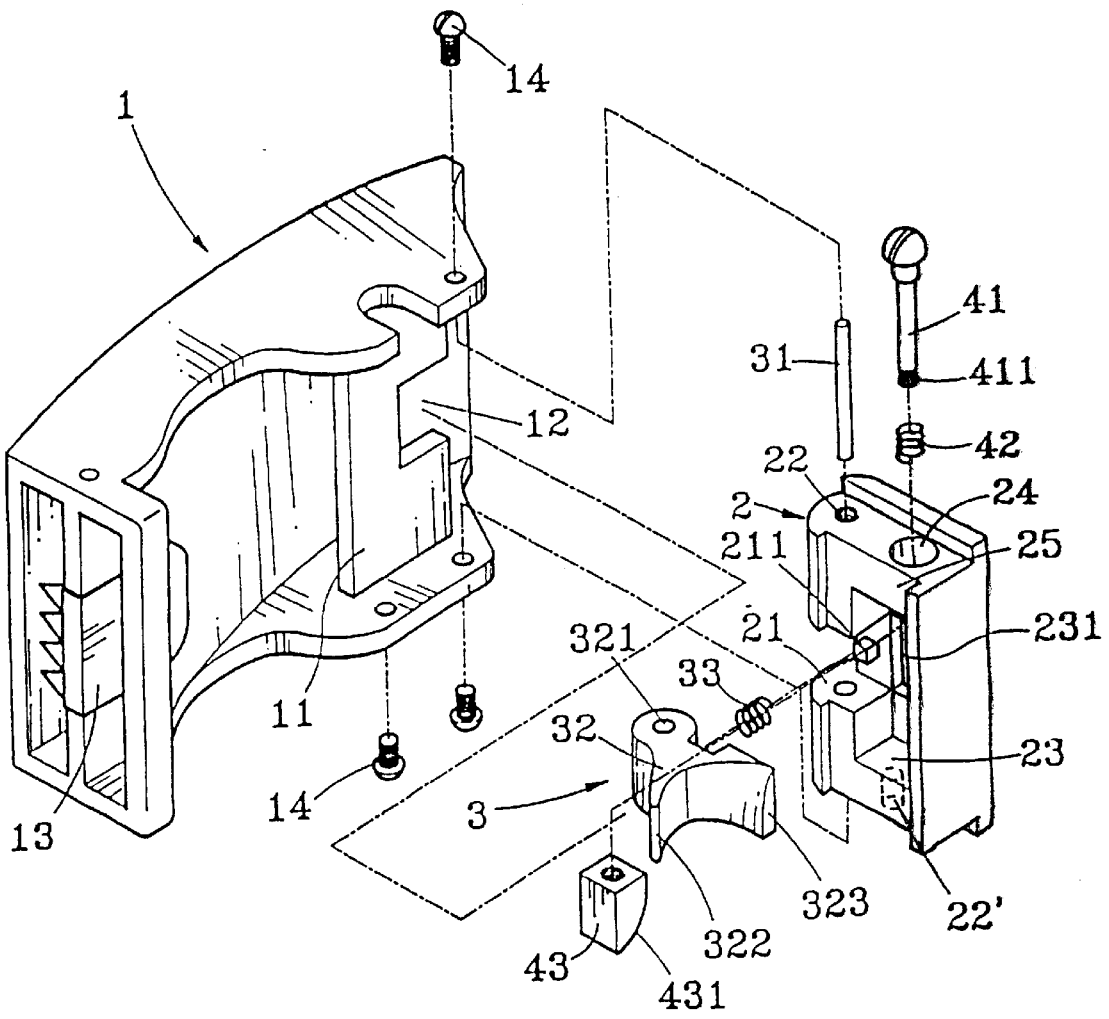
FIG. 2 is an exploded view of the belt buckle shown in FIG. 1.

Referring to FIGS. 1 and 2, a belt buckle in accordance with the present invention is generally comprised of a base frame 1, a holder frame 2, a locking mechanism 3, and a release control unit 4. The base frame 1 comprises a locating plate 11 at one end, and a clamp 13 at an opposite end adapted to secure a lead end of a belt to the base frame 1. The locating plate 11 has a notch 12. The locking mechanism 3 is comprised of a pivot 31, a locking lever 32, and a spring 33. The locking lever 32 comprises a pivot hole 321 on the middle, a tooth 322 at one end, and an arched handle 323 at an opposite end. The holder frame 2 comprises a front opening 21, two screw holes 22;22 aligned at two opposite sides of the front opening 21, a stub rod 211 disposed in the front opening 21 and adapted to hold the spring 33 of the locking mechanism 3, a hole 231, a chamber 23 disposed in communication between the front opening 21 and the hole 231, a bolt hole 24 disposed in parallel to the pivot hole 22 and in communication with the chamber 23, and a coupling wall 25. The release control unit 4 is comprised of a control bolt 41, a spring 42, and a pressure block 43. The pressure block 43 has a bevel bottom edge 431. The pivot 31 is mounted in the pivot holes 22;22' on the holder frame 2 and the pivot hole 321 on the locking lever 32 and transversely connected to the front end of the base frame 1 by screws 14. The coupling wall 25 of the holder frame 2 is forced into engagement with the locating plate 11 of the base frame 1. The locking lever 32 is turned about the pivot 31 in the front opening 21, permitting the tooth 322 to be moved in and out of the notch 12 on the locating plate 11. The spring 33 is mounted on the stub rod 211 inside the front opening 21 of the holder frame 2, and imparts an outward pressure to the locking lever 32, causing the tooth 322 of the locking lever 32 to be forced into the notch 12 on the locating plate 11. The control bolt 41 is mounted in the bolt hole 24. The spring 42 is mounted in the bolt hole 24 around the control bolt 41, and imparts an outward pressure to the control bolt 41. The pressure block 43 is fastened to the bottom end 411 of the control bolt 41 and suspended in the chamber 23.

Figure 3:
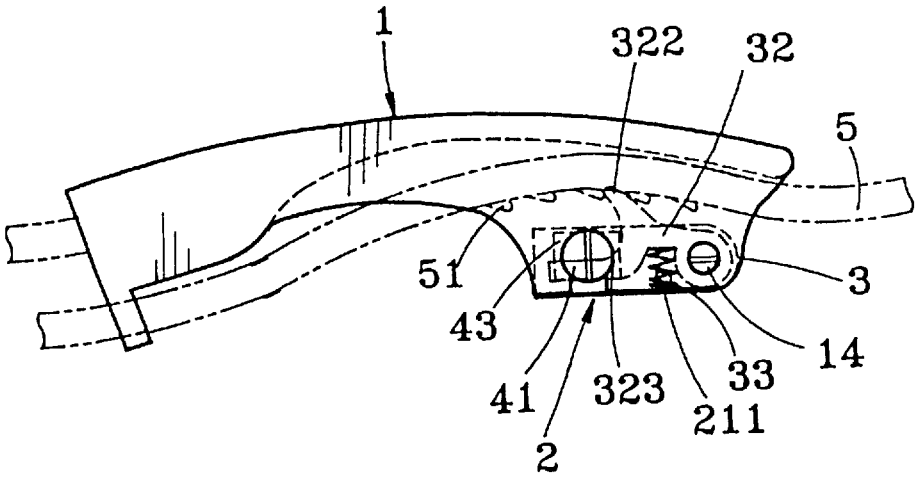
FIG. 3 is a side view in section of the present invention, showing the tooth of the locking mechanism engaged with the serrated portion on the belt.
Figure 4:
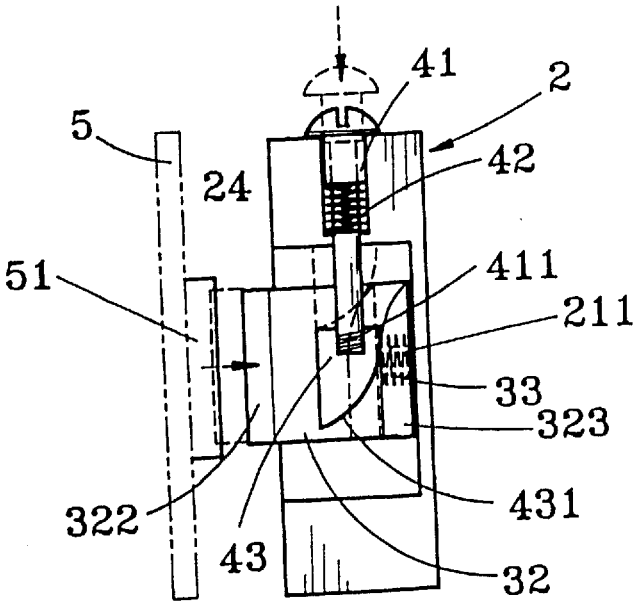
FIG. 4 is a sectional view taken along line IV—IV of FIG. 1.

Referring to FIGS. 3 and 4, when the tail end of the belt 5 is inserted into the base frame 1, the serrated portion 51 at the back side of the belt 5 is moved over the tooth 322 of the locking lever 32. When the belt 5 is pulled backwards to remove its tail end from the base frame 1, the serrated portion 51 becomes forced into engagement with the tooth 322 of the locking lever 32, and therefore the tail end of the belt 5 is prohibited from a backward movement. When the bolt 41 is depressed, the pressure block 43 is moved forwards to force its bevel bottom edge 43 against the arched handle 323 of the locking lever 32, thereby causing the locking lever 32 to turn about the pivot 31 and to lift the tooth 322 from the serrated portion 51 on the belt 5, and therefore the tail end of the belt 5 is released and can be removed from the base frame 1. When the control bolt 41 is released from the hand, the spring 42 immediately forces the control bolt 41 outwards to its former position.

What is claimed is:

1. A belt buckle comprising:

a base frame fastened to a lead end of a belt, having a locating plate at one end, said locating plate having a notch;

a holder frame (2) fastened to said base frame, said holder frame comprising a coupling wall forced into engagement with said locating plate of said base frame, a chamber, a front opening disposed in communication with said chamber;

a locking mechanism pivoted to said holder frame in its front opening and moved between a locking position where said locking mechanism is moved into the notch on said locating plate to hold down a tail end of said belt, and an unlocking position where said locking mechanism is moved out of the notch on said locking plate to release the tail end of said belt; and a release control unit mounted in said chamber of said holder frame and controlled to move said locking mechanism from said locking position to said unlocking position.

2. The belt buckle of claim 1, wherein said release control unit comprises a control member, a pressure block fastened to said control member and forced by it to move said locking mechanism from said locking position to said unlocking position, and spring means adapted to impart a pressure to said control member, causing said control member to move said pressure block away from said locking mechanism.

3. The belt buckle of claim 2, wherein said control member is a bolt having a bottom end fastened to said pressure block.

4. The belt buckle of claim 2, wherein said pressure block has a bevel bottom edge adapted to act against said locking mechanism.

5. The belt buckle of claim 1, wherein said locking mechanism comprises a pivot mounted in pivot holes on said holder frame, a locking lever turned about said pivot in the front opening of said holder frame, and spring means connected between said locking lever and a stub rod inside the front opening of said holder frame, the spring means of said locking mechanism imparting a pressure to said locking lever, causing said locking lever to be moved to said locking position.

6. The belt buckle of claim 5, wherein said locking lever comprises a tooth at one end adapted to engage the tail end of said belt, and an arched handle at an opposite end adapted to act against said release control unit.

7. The belt buckle of claim 1, wherein said holder frame is fixedly secured to said base frame by screws.

8. The belt buckle of claim 1, wherein said base frame comprises a clamp adapted to secure the lead end of said belt.

* * * * *